US009508281B2

(12) United States Patent
Kao et al.

(10) Patent No.: US 9,508,281 B2
(45) Date of Patent: Nov. 29, 2016

(54) APPARATUS AND METHOD FOR IMAGE ANALYSIS AND IMAGE DISPLAY

(71) Applicant: Wistron Corporation, New Taipei (TW)

(72) Inventors: Meng-Chao Kao, New Taipei (TW); Tzu-Chiang Shen, New Taipei (TW); Hui-Chen Lin, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 14/477,866

(22) Filed: Sep. 5, 2014

(65) Prior Publication Data

US 2015/0348456 A1 Dec. 3, 2015

(30) Foreign Application Priority Data

May 30, 2014 (TW) ..... 103119009 A

(51) Int. Cl.

*G09G 5/10* (2006.01)
*G09G 3/20* (2006.01)
*G09G 3/00* (2006.01)

(52) U.S. Cl.

CPC ..... *G09G 3/2007* (2013.01); *G09G 3/006* (2013.01); *G09G 2320/0233* (2013.01); *G09G 2320/0285* (2013.01); *G09G 2360/16* (2013.01)

(58) Field of Classification Search

CPC ..... G09G 3/3607
USPC ..... 345/63, 87, 211, 690
See application file for complete search history.

(56) References Cited

U.S. PATENT DOCUMENTS 7,342,578 B2 * 3/2008 Joo ..... G09G 3/288 345/211
8,169,431 B2 5/2012 Kerofsky
8,817,120 B2 * 8/2014 Silverstein ..... G06T 5/005 348/208.14
2012/0133670 A1 * 5/2012 Kim ..... G09G 5/02 345/593

FOREIGN PATENT DOCUMENTS

CN 101911172 12/2010

OTHER PUBLICATIONS

"Office Action of Taiwan Counterpart Application," issued on Aug. 24, 2015, p. 1-p. 7, with English translation thereof.

* cited by examiner

*Primary Examiner* — Calvin C Ma
(74) *Attorney, Agent, or Firm* — Jianq Chyun IP Office

(57) ABSTRACT

An apparatus and a method for image analysis and image display are provided. The image display apparatus includes a storage device, a processor, and a display. The storage device stores at least one gain table. Each gain table includes a plurality of gain values. There is a corresponding relationship between the plurality of gain values and a plurality of pixels of an image. For each gray level value of each of the pixels, the processor determines a gain value corresponding to the gray level value according to the at least one gain table. In addition, the processor compensates the image according to the gain values corresponding to the gray level values. The display displays the compensated image.

8 Claims, 3 Drawing Sheets

APPARATUS AND METHOD FOR IMAGE ANALYSIS AND IMAGE DISPLAY

CROSS-REFERENCE TO RELATED APPLICATION

This application claims the priority benefit of Taiwan application serial no. 103119009, filed on May 30, 2014. The entirety of the above-mentioned patent application is hereby incorporated by reference herein and made a part of this specification.

BACKGROUND

Field of the Invention

The disclosure is directed to an apparatus and a method for image processing and more particularly, to an apparatus and a method for image analysis and image display.

Description of Related Art

In some flat-panel displays, a mura phenomenon of uneven brightness (i.e., in which some regions are brighter, some regions are dimmer, and the brighter regions and the dimmer regions are distributed irregularly) may occur even if a displayed image has only one single color. Such uneven brightness phenomenon may be resulted from poor design in light field of backlight of the display, unevenness of optical films (e.g., a light guide plate and diffuser plate), or even resulted from smudginess inside the display.

Unlike obvious defects, such as defect pixel, broken line, etc. or difference in specifications, such as brightness and chrominance, the uneven brightness is mainly detected by human eyes, and such subjective determination may be inconsistent and prone to controversy. When the uneven brightness of the display is too obvious, purchase of whole batch of displays may be returned by consumers who consider them unacceptable, or the displays may be treated as with lower quality level, which cause affection to the price.

In order to solve the issue of uneven brightness, a diffusion degree of the optical films in the display can be increased, which however, leads to increase in the cost.

SUMMARY

The disclosure provides an apparatus and a method for image analysis and image display for eliminating and mitigating uneven brightness for a display.

The disclosure is directed to an image analysis apparatus, including an image capture device, a processor and a storage device. The image capturing device captures a first image displayed by a display to generate a second image. The processor is coupled to the image capture device, determines at least one target value according to a plurality of brightness values of a plurality of pixels of the second image and generates at least one gain table according to the at least one target value. Each of the gain tables corresponds to one of the target values. Each of the pixels of the second image corresponds to one of the plurality of gain values in each of the at least one gain table. The storage device is coupled to the processor and stores the at least one gain table.

The disclosure is directed to an image display apparatus, including a storage device, a processor, and a display. The storage device stores at least one gain table. Each gain table includes a plurality of gain values. A corresponding relationship is between the gain values and a plurality of pixels of an image. The processor is coupled to the storage device. For each of the gray level values of each of the pixels, the processor determines a gain value corresponding to the gray level value according to the at least one gain table and compensates the image according to the gain values corresponding to the gray level values. The display is coupled to the processor and displays the compensated image.

The disclosure is directed to an image analysis method, including the following steps. A first image displayed by a display is captured to generate a second image. At least one target value is determined according to a plurality of brightness values of a plurality of pixels of the second image. At least one gain table is generated according to the at least one target value, where each of the at least one gain table corresponds to one of the target values, and each of the pixels of the second image corresponds to one of the plurality of gain values in each of the at least one gain table. The at least one gain table is stored.

The disclosure is directed to an image display method, including the following steps. At least one gain table is stored, where each of the at least one gain table includes a plurality of gain values, and a corresponding relationship is between the plurality of gain values and a plurality of pixels of an image. For each of the gray level values of each of the pixels, a gain value corresponding to the gray level value is determined according to the at least one gain table. The image is compensated according to the gain values corresponding to the gray level values. The compensated image is displayed.

To sum up, in the disclosure, the image displayed by the display can be compensated according to the gain values in the gain table.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The invention utilizes an image signal processing method to perform a compensation (for adjusting brighter or dimmer) on pixels in an image displayed by a display, so as to eliminate or mitigate uneven brightness for the display. For each gray level of each pixel, bright regions and dark regions when the uneven brightness occurs may vary in different unevenness degrees and distribution shapes. Thus, in the disclosure, a plurality of gray levels which may be presented by the pixels are considered, such that pixels with different gray level values may be compensated in various degrees.

Figure 1:
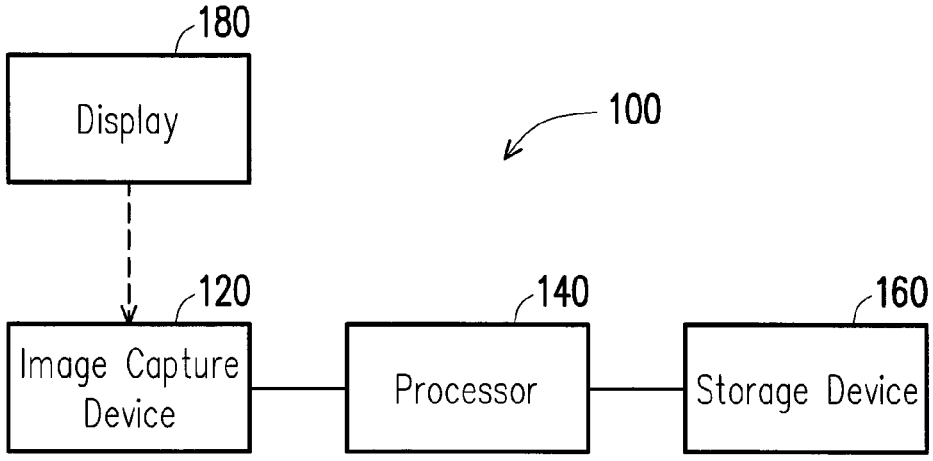
FIG. 1 is a schematic diagram of an image analysis apparatus according to an embodiment of the disclosure.

FIG. 1 is a schematic diagram of an image display apparatus 100 according to an embodiment of the disclosure. The image analysis apparatus 100 includes an image capture device 120, a processor 140 and a storage device 160. The processor 140 is coupled to the image capture device 120 and a storage device 160. The image capture device 120 may be any electronic apparatus capable of transforming received optical signals into a digital image, such as a digital camera. The storage device 160 may be any electronic apparatus capable of storing data, such as a memory or a disk drive.

Figure 2:
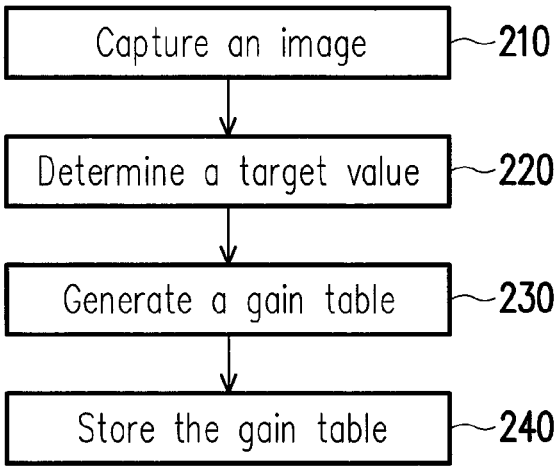
FIG. 2 is a flowchart of an image analysis method according to an embodiment of the disclosure.

FIG. 2 is a flowchart of an image analysis method according to an embodiment of the disclosure. The image analysis method illustrated in FIG. 2 may be executed by the image analysis apparatus 100. In step 210, the image capture device 120 captures an image $I_1$ displayed by a display 180 to generate an image $I_2$. The display 180 may be coupled to the processor 150 and controlled thereby. The display 180 may also be controlled by another electronic apparatus.

Step 210 aims to measure the uneven brightness for the display 180. The image $I_1$ may be a black and white image or a color image. In case the image $I_1$ is the black and white image, each pixel of the image $I_1$ includes only one gray level value. In case the image $I_1$ is the color image, each pixel of the image $I_1$ includes a plurality of gray level values. For example, in a general type color display, each pixel includes three gray level values corresponding to the primary colors of red, green and blue, respectively. In order to accurately measure the uneven brightness for the display 180, the image $I_1$ may be an evenly white image or an evenly gray image. In other words, each gray level value of each pixel of the image $I_1$ may be identical.

The image $I_2$ includes a plurality of pixels. If the uneven brightness occurs in the display 180, the pixels of the image $I_2$ may include a plurality of different brightness values instead of one single brightness value. The processor 140 may determine a target value according to a plurality of brightness values of the pixels of the image $I_2$ in step 220. The target value may be selected from a brightness range of the pixels of the image $I_2$. Namely, the target value is greater than or equal to a minimum value among the brightness values of the image $I_2$, and the target value is less than or equal to a maximum value among the brightness values of the image $I_2$. Then, in step 230, the processor 140 generates a gain table according to the target value. The storage device 160 may stores the gain table in step 240.

Each of the image $I_1$ and the image $I_2$ is a two-dimensional array composed of pixels, and the gain table is a two-dimensional array composed of a plurality of gain values. Each pixel of the image $I_1$ corresponds to a gain value in the same position in the gain table, and each gain value of the gain table corresponds to a pixel in the same position in the image $I_2$. Each of the gain values in the gain table is equal to the target value divided by the brightness value of the pixel of the image $I_2$ corresponding to the gain value.

For example, in case the image $I_1$ is an all-white image. In other words, each gray level value of each pixel of the image $I_1$ is a maximum gray level value corresponding to a gray level resolution of the image $I_1$. The gain table generated in this way corresponds to the maximum gray level value. In case the gray level resolution of the image $I_1$ is 8-bit, the corresponding maximum gray level value is 255. The processor 140 may find a maximum value and a minimum value among the brightness values of the pixels of the image $I_2$, where it is assumed that the maximum value is 479 and the minimum value is 294 in this case. Because the all-white image is already the brightest image, the pixels therein cannot be any brighter but only dimmer. In order to make the compensated image to have even brightness, a minimum value 294 among the brightness values of the pixels is used as the target value to generate the gain table. As a simple example, it is assumed that dimensions of the image $I_1$, the image $I_2$ and the gain table are 6×4. In Table 1 below, the brightness values of the pixels of the image $I_2$ are listed. Table 2 is a gain table, in which each of the gain values is equal to the target value 294 divided by the brightness value of the pixel of the image $I_2$ corresponding to the gain value.

TABLE 1

| the brightness values of the pixels of the image $I_2$ | | | | | |
|---|---|---|---|---|---|
| 460 | 475 | 468 | 441 | 426 | 294 |
| 466 | 479 | 472 | 452 | 398 | 305 |
| 395 | 433 | 462 | 404 | 325 | 317 |
| 321 | 384 | 440 | 365 | 310 | 294 |

TABLE 2

| the gain table | | | | | |
|---|---|---|---|---|---|
| 0.64 | 0.62 | 0.63 | 0.67 | 0.69 | 1.00 |
| 0.63 | 0.61 | 0.63 | 0.65 | 0.74 | 0.96 |
| 0.74 | 0.68 | 0.64 | 0.73 | 0.90 | 0.93 |
| 0.92 | 0.77 | 0.67 | 0.81 | 0.95 | 1.00 |

The image analysis apparatus 100 may execute the image analysis method illustrated in FIG. 2 for many times to generate a plurality of gain tables. The gain tables correspond to different images $I_1$, correspond to different target values and correspond to different gray level values. For example, when the image analysis apparatus 100 executes the image analysis method illustrated in FIG. 2 for the second time, the image $I_1$ may be an evenly medium-gray image. The medium-gray image as referred to herein indicates that each gray level value of each pixel of the image $I_1$ is an intermediate gray level value corresponding to a gray level resolution of the image $I_1$. The gain table generated this time corresponds to the intermediate gray level value. In case the gray level resolution of the image $I_1$ is 8-bit, the corresponding intermediate gray level value is 127 or 128. If it is assumed that among the brightness values of the pixels of the image $I_2$ captured by in step 210, the maximum value is 242 and the minimum value is 148, the intermediate value of the brightness values of the pixels of the image $I_2$, which is also the mean value of the maximal value 242 and the minimum value 148, is used as the target value, and another gain table is generated in the same way as the aforementioned method does.

To eliminate or mitigate the uneven brightness for the display, the displayed image may be compensated by using the gain values in the gain table. Namely, each gray level value of each pixel of the image $I_1$ is multiplied by a corresponding gain value. In the gain table listed in Table 2, the minimum value among the pixel brightness values of the image $I_2$ is used as the target value. Thus, each gain value in Table 2 is less than or equal to 1. In this way, brighter pixels in the image are adjusted dimmer to be consistent with the dimmest pixel, which however, cause loss in backlight efficiency of the display. If the intermediate value of the pixels brightness values of the image $I_2$ is used as the target value, the gain value corresponding to each dimmer pixels is greater than 1, so as to reduce the loss in the backlight efficiency of the display.

However, it is to be noted that the selection of the target value causes affection to the gain values, such that the gray level values in the compensated image are also affected. The selection of the target value should not cause the gray level values in the compensated image to be greater than the maximum gray level value corresponding to the gray level resolution of the image.

Figure 3:
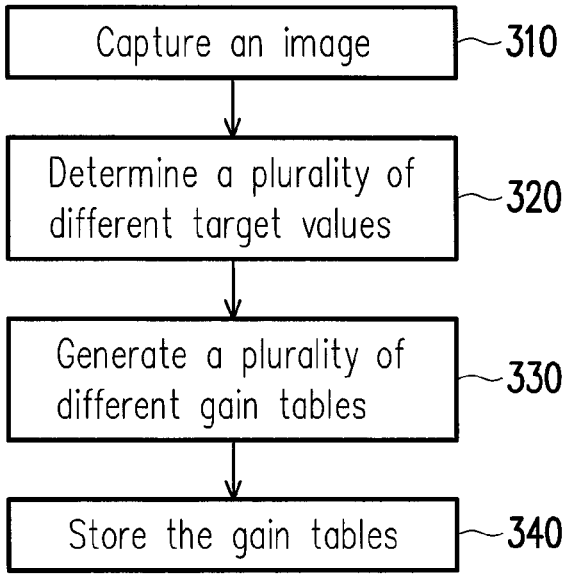
FIG. 3 is a flowchart of an image analysis method according to another embodiment of the disclosure.

FIG. 3 is a flowchart of an image analysis method according to another embodiment of the disclosure. Step 310 is the same as step 210, where only one image $I_1$ is captured. The processor 140 may determine a plurality of different target values according to a plurality of brightness values of the pixels of the image $I_2$ in step 320. Then, in step 330, the processor 140 generates a plurality of different gain tables according to the target values. The storage device 160 may stores the gain tables in step 340.

For example, the image $I_1$ may be an all-white image. As above, it is assumed that among the brightness values of the pixels of the image $I_2$, the maximum value is 479 and the minimum value is 294. The processor 140 may determine two target values in step 320. The first target value is the minimum value 294, and the second target value if the intermediate value of the brightness values of the pixels of the image $I_2$, that is, the mean value 387 of the maximum value 479 and the minimum value 294. Then, in step 330, the processor 140 generates two gain tables. The first gain table corresponds to the first target value, i.e., the minimum value 294 and corresponds to the maximum gray level value corresponding to the gray level resolution of the image $I_1$. Each of the gain values of the first gain table is equal to the minimum value 294 divided by the brightness value of the pixel of the image $I_2$ corresponding to the gain value. The second gain table corresponds to the second target value, i.e., the intermediate value 387 and corresponds to the intermediate gray level value corresponding to the gray level resolution of the image $I_1$. Each gain value of the second gain table is equal to the minimum value 387 divided by the brightness value of the pixel of the image $I_2$ corresponding to the gain value.

Figure 4:
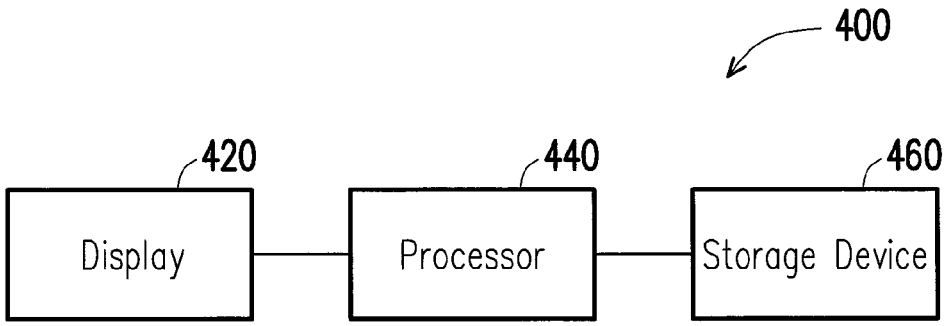
FIG. 4 is a schematic diagram of an image display apparatus according to an embodiment of the disclosure.

FIG. 4 is a schematic diagram of an image display apparatus 400 according to an embodiment of the disclosure. The image analysis apparatus 400 includes a display 420, a processor 440 and a storage device 460. The processor 440 is coupled to the display 420 and a storage device 460. To effectively eliminate or mitigate the uneven brightness, the display 420 and display 180 should have to the same or similar brightness distribution. For example, the display 420 and the display 180 may be displays of the same brand and model, manufactured in the same process, or the same display.

Figure 5:
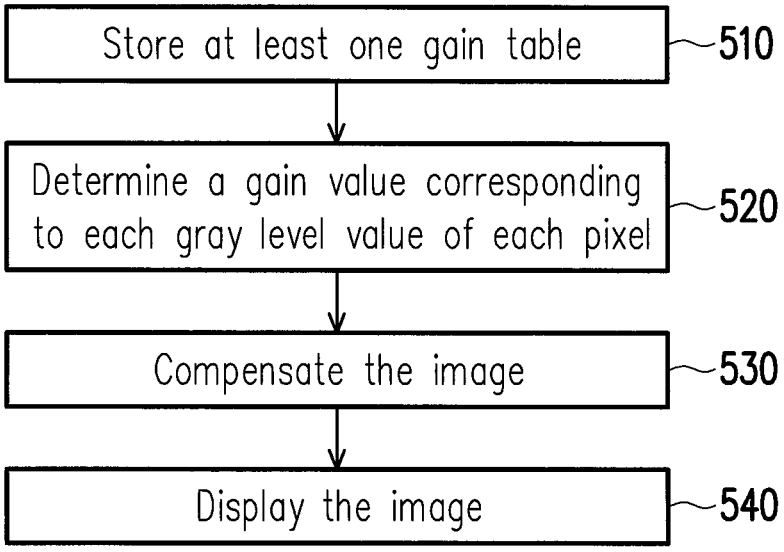
FIG. 5 is a flowchart of an image display method according to an embodiment of the disclosure.

FIG. 5 is a flowchart of an image display method according to an embodiment of the disclosure. The image display method illustrated in FIG. 5 may be executed by the image display apparatus 400. In step 510, the storage device stores at least one gain table generated by the image analysis apparatus. Each gain table corresponds to a gain value and includes a plurality of gain values, where each of the gain values corresponds to one of a plurality of pixels of an image I displayed by the display 420. In other words, each pixel of the image I corresponds to a gain value in each gain table.

For each gray level value of each pixel of the image I, the processor 440 determines the gain value corresponding to the gray level value according to the at least one gain table stored in the storage device 460 in step 520 and multiplies the gravel level value by the gain value corresponding to the gray level value to compensate the image I in step 530. The display 420 displays the compensated image I in step 540.

Hereinafter, how the processor 440 determines the gain value corresponding to each of the gray level values according to the gain table will be described. It is assumed that the processor 440 has to determine a gain value $G_V$ corresponding to a certain gray level value V of a certain pixel of the image I. According to the above description, each gain table stored in the storage device 460 corresponding to a gray level value. Thus, each gain table is used for compensating the gray level value corresponding to the gain table. When the gray level value V is equal to a gray level value corresponding to a certain gain table, the gain value $G_V$ corresponding to the gray level value V is the gain value in the gain table corresponding to the pixel P. The processor 440 multiplies the gravel level value V of the pixel P by the corresponding gain value $G_V$ to compensate the image I in step 530.

For example, in case the gray level resolution of the image I is 8-bit, the corresponding maximum gray level value is 255, and the corresponding intermediate gray level value is 128. In a scenario, it is assumed that the storage device 460 stores two gain tables, where the first gain table corresponds to the maximum gray level value 255, and the second gain table corresponds to the intermediate gray level value 128. When the gray level value V corresponding to the pixel P is 255, the gain value $G_V$ in the first gain table corresponding to the pixel P. When the gray level value V corresponding to the pixel P is 128, the gain value $G_V$ in the second gain table corresponding to the pixel P.

On the other hand, when the gray level value V is not equal to the gray level value corresponding to each gain table, the processor 440 calculates the gain value $G_V$ corresponding to the gray level value V of the pixel P according to at least one gray level value corresponding to the at least one gain table stored in the storage device 460, the gray level value V of the pixel P and at least one gain value in the at least one gain table corresponding to the pixel P.

In the aforementioned example, when the gray level value V is not equal to 225 nor 128, the processor 440 may calculate the gain value V corresponding to the gray level value V by using the two gain tables and interpolation. When the gray level value V is between 225 and 128, the processor 440 may calculate the gain value $G_V$ by using formula (1) as follows.

$$G_V=((V-128)\times G_{255}+(255-V)\times G_{128})/(255-128) \quad (1)$$

In formula (1), $G_{255}$ is a gain value in the first gain table corresponding to the pixel P, and $G_{128}$ is a gain value in the second gain table corresponding to the pixel P.

When the gray level value V is between 128 and 0, the processor 440 may calculate the gain value $G_V$ by using formula (2) as follows.

$$G_V=(V\times G_{128}+(128-V)\times G_0)/128 \quad (2)$$

In formula (2), $G_0$ is a gain value corresponding to a gray level value of 0, and $G_0$ is equal to 1 since the image is not compensated when the gray level value is 0.

According to the illustration with respect to the method flow of FIG. 2, the purpose of each gain value of each gain table is to dimmer the pixels in the bright region or brighter the pixels in the dark region. Thus, compensating each gray level value of each pixel by using the corresponding gain value leads the pixels of the same color to consistency in displaying brightness in any positions, such that the uneven brightness can be eliminated and mitigated for the display.

Even though two gain tables are used in the embodiment above, the invention is not intended to limit the number of the gain tables. In other embodiments, the image analysis apparatus 100 can generate any number of gain tables, and the image display apparatus 400 can also use any number of gain tables. The more the number of gain tables, the higher the compensation quality. Preferably, each gray level value accepted by the gray level resolution of the image I has a corresponding gain table. In this way, the corresponding gain value $G_V$ can be obtained by looking up the tables for any gray level value V of any certain pixel of the image I. If the number of the gain tables is smaller, and the gray level value V has no corresponding gain table, the processor 440 may calculate the corresponding gain value $G_V$ by means of the interpolation. Alternatively, the processor 440 may also calculate the gain value $G_V$ according to the current gain table by means of extrapolation or curve fitting.

To conclude, in the invention, difference in the display brightness resulted from the uneven brightness of the display can be detected and analyzed to generate the gain tables, and the image is compensated by using the gain tables to the eliminate or mitigate the issue of uneven brightness, such that the yield and the quality of the display can be improved. The image compensation proposed by the invention can contribute to dimmer or brighter the pixels, so as to maintain the entire brightness of the display screen and reduce the loss of the backlight efficiency of the display. The invention contributes to performing different degrees of compensation for different gray level values of the pixels, which leads to the compensation result to perfectly meeting the image in expectation. The invention does not require any modification of the hardware design of the display, which causes no increase to the hardware cost of the display.

What is claimed is:

1. An image display apparatus, comprising:

a storage device, storing at least one gain table, wherein each of the at least one gain table comprises a plurality of gain values, a corresponding relationship is between the plurality of gain values and a plurality of pixels of an image, the gain table is generated according to a minimum value among a plurality of brightness values of the pixels, and the gain value of a pixel is the minimum value divided by a brightness value of the pixel, wherein a gray level value of each of the pixels of the image are identical and a brightness value of at least two of the pixels of the image are not identical;

a processor, coupled to the storage device, for each gray level value of each of the pixels, determining a gain value corresponding to the gray level value according to the at least one gain table and compensating the image according to the plurality of gain values corresponding to the plurality of gray level values; and a display, coupled to the processor, displaying the compensated image, wherein the brightness value of all of the pixels of the compensated image are identical.

2. The image display apparatus according to claim 1, wherein each of the at least one gain table corresponds to a gray level value, and for each of the gray level values of each of the pixels, when the gray level value of the pixel is equal to the gray level value corresponding to one of the at least one gain table, the gain value corresponding to the gray level value of the pixel is the gain value in the gain table corresponding to the pixel.

3. The image display apparatus according to claim 1, wherein each of the at least one gain table corresponds to a gray level value, and for each of the gray level values of each of the pixels, when the gray level value of the pixel is not equal to the gray level value corresponding to each of the at least one gain table, the processor calculates the gain value corresponding to the gray level value of the pixel according to the at least one gray level value corresponding to the at least one gain table, the gray level value of the pixel and at least one gain value in the at least one gain table corresponding to the pixel.

4. The image display apparatus according to claim 1, wherein for each of the gray level values of each of the pixels, the processor multiplies the gravel level value by the gain value corresponding to the gray level value to compensate the image.

5. An image display method, comprising:

storing at least one gain table, wherein each of the at least one gain table includes a plurality of gain values, a corresponding relationship is between the plurality of gain values and a plurality of pixels of an image, the gain table is generated according to a minimum value among a plurality of brightness values of the pixels, and the gain value of a pixel is the minimum value divided by a brightness value of the pixel, wherein a gray level value of each of the pixels of the image are identical and a brightness value of at least two of the pixels of the image are not identical;

for each gray level value of each of the pixels, determining a gain value corresponding to the gray level value according to the at least one gain table;

compensating the image according to the plurality of gain values corresponding to the plurality of gray level values; and displaying the compensated image, wherein the brightness value of all of the pixels of the compensated image are identical.

6. The image display method according to claim 5, wherein each of the at least one gain table corresponds to a gray level value, and for each of the gray level values of each of the pixels, when the gray level value of the pixel is equal to the gray level value corresponding to one of the at least one gain table, the gain value corresponding to the gray level value of the pixel is the gain value corresponding to the pixel in the gain table.

7. The image display method according to claim 5, wherein each of the at least one gain table corresponds to a gray level value, and for each of the gray level values of each of the pixels, when the gray level value of the pixel is not equal to the gray level value corresponding to each of the at least one gain table, the image display method further comprises:

calculating the gain value corresponding to the gray level value of the pixel according to the at least one gray level value corresponding to the at least one gain table, the gray level value of the pixel and at least one gain value in the at least one gain table corresponding to the pixel.

8. The image display method according to claim 5, wherein for each of the gray level values of each of the pixels, the image display method further comprises:

multiplying the gravel level value by the gain value corresponding to the gray level value to compensate the image.

* * * * *